United States Patent [19]

Barber

[11] Patent Number: 5,061,211

[45] Date of Patent: Oct. 29, 1991

[54] AMPHIBIAN AIR CAR

[76] Inventor: Jerry L. Barber, 10 Whittington Ct., Greenville, S.C. 29615

[21] Appl. No.: 660,980

[22] Filed: Feb. 26, 1991

Related U.S. Application Data

[63] Continuation of Ser. No. 382,439, Jul. 19, 1989, abandoned.

[51] Int. Cl.[5] ..... A63G 1/08

[52] U.S. Cl. ..... 440/37; 104/76; 272/29

[58] Field of Search ..... 114/43, 61, 270; 440/37, 38, 280, 286; D12/300, 305; 104/53, 59, 70, 72–74, 76; 180/7.1, 7.4, 116, 117, 123–127, 129, 130; 272/29, 32; 244/101, 105, 106

[56] References Cited

U.S. PATENT DOCUMENTS

| | | | |
|---|---|---|---|
| 1,569,780 | 1/1926 | Nock | 272/29 |
| 1,718,036 | 6/1929 | Douglass | 440/37 |
| 1,756,442 | 4/1930 | Temens | 440/37 |
| 3,384,198 | 5/1968 | Jones | 440/37 |
| 3,903,832 | 9/1975 | Ishida | 440/37 |
| 3,949,679 | 4/1972 | Barber | 272/29 |
| 4,230,198 | 10/1980 | Eickmann | 440/37 |
| 4,522,390 | 6/1985 | Kudler | 272/29 |
| 4,903,959 | 2/1990 | Barber | 272/29 |

*Primary Examiner*—Joseph F. Peters, Jr.
*Assistant Examiner*—Clifford T. Bartz
*Attorney, Agent, or Firm*—Dority & Manning

[57] ABSTRACT

An amusement ride car is disclosed as having a pair of driving propellers mounted at the rear of the car operating in the manner of an air boat. The propellers are driven individually, and each is arranged for forward and reverse directional rotation thereby permitting the forward and reverse movement of the car as well as turning movement thereof when opposite rotation is effected. The car can be supported for near frictional movement upon a riding platform by means of water, caster wheels, or the combination thereof, or by means of air flotation principles. Rotational speed of the propellers, and their direction of rotation, is under control of control devices made available for one of the passengers.

4 Claims, 3 Drawing Sheets

AMPHIBIAN AIR CAR

This is a continuation of application U.S. Ser. No. 07/382,439, filed July 19, 1989, which was abandoned upon the filing hereof.

BACKGROUND OF THE INVENTION

The present invention is directed to an amusement apparatus similar to a swamp airboat adapted for use in amusement parks or semi-trailer trucks which are devised for amusement rides.

There are many conventional varieties of amusement cars which are arranged for one or more passengers to control the movement and speed of the car upon a riding platform. The platform itself may take a variety of forms such as air flotation, caster wheels, and water flotation arrangements. In propelling these amusement cars, use is generally made of electrical motors providing rotational force to one or more driving wheels associated with a car. In the case of a water platform, use is made of moving water alone or in combination with a drive chain for carrying the car over areas which cannot be propelled by the use of water.

While the conventional amusement rides involve many forms of motion imparting devices for permitting the passengers to experience corresponding forms of thrill and amusement, none has been devised which will give the effect of a swamp airboat except for the use of such vehicles in the large expanses of swamps.

In the prior art, there are a variety of known adapted for movement on ice. Examples of airboats are illustrated and described in U.S. Pat. Nos. 1,816,118; 2,855,885; 3,176,647; and 4,015,555. All of these vehicles employ a single propeller as a drive force and are not adapted for land travel at slow and very slow speeds suitable for use in the environment of an amusement park.

There are known amusement rides which employ boats movable on water or in combination with other means for supporting and propelling the boat. In U.S. Pat. No. 779,464, a vessel in a whirlpool amusement ride is supported for helical and downward movement by wheels movable upon suitable rails. Water cascades over the side walls and bottom portion of the vessel for desired water effects. In U.S. Pat. No. 1,448,306, a boat is chain driven and wheels are utilized to impart rocking motion to the boat. In U.S. Pat. No. 3,003,430, a boat guiding arrangement is disclosed for use in an amusement ride as including a rail submerged in water in order to guide the boat's movement along a predetermined course.

All of the amusement ride devices in the above-cited art fail in regard to the provision of random or free-wheeling motion. With respect to the airboat art, none of the patents disclose a twin propeller arrangement for steering purposes. Rather, the conventional air rudders or boat rudders are employed and operated in the conventional manner.

SUMMARY OF THE INVENTION

Therefore, it is the principal object of the present invention to enhance the field of amusement rides by incorporating airboat technology in the form of an amphibian air car into appropriately devised amusement cars.

Another object of the invention is to utilize a novel form of airboat in the environment of an amusement ride, thereby providing the illusion of driving an airboat.

Another object of the present invention is to incorporate water flotation environment upon a mobile vehicle such as a semi-trailer truck for permitting the easy and quick setting up and dismantling of an amusement ride adapted for use on water.

In order to achieve the objects, the present invention has been devised in the form of an amphibian air car for use in an amusement vehicle car or body adapted for one or more passengers. The vehicle body or car is provided with two propellers for imparting propulsion to the car upon a riding platform which may take a variety of forms such as air flotation, a plurality of swivelable caster wheels, water, or a combination of water and caster wheels. The propeller shafts are connected by way of drive chains or pulleys to a drive mechanism arranged for permitting individual rotation of the propellers in a forward direction or a reverse direction or in a neutral position so that the vehicle may be propelled forward, in reverse, or in a turning movement by the rotation of the propellers in opposite directions. A control throttle and drive mechanism is provided for one of the passengers to control the rotation of the propellers and the rotational direction thereof.

These and other objections of the present invention will become apparent after reading the following description taken in conjunction with the drawings wherein:

DETAILED DESCRIPTION OF THE DRAWINGS

DESCRIPTION OF PREFERRED EMBODIMENTS

Figure 1:
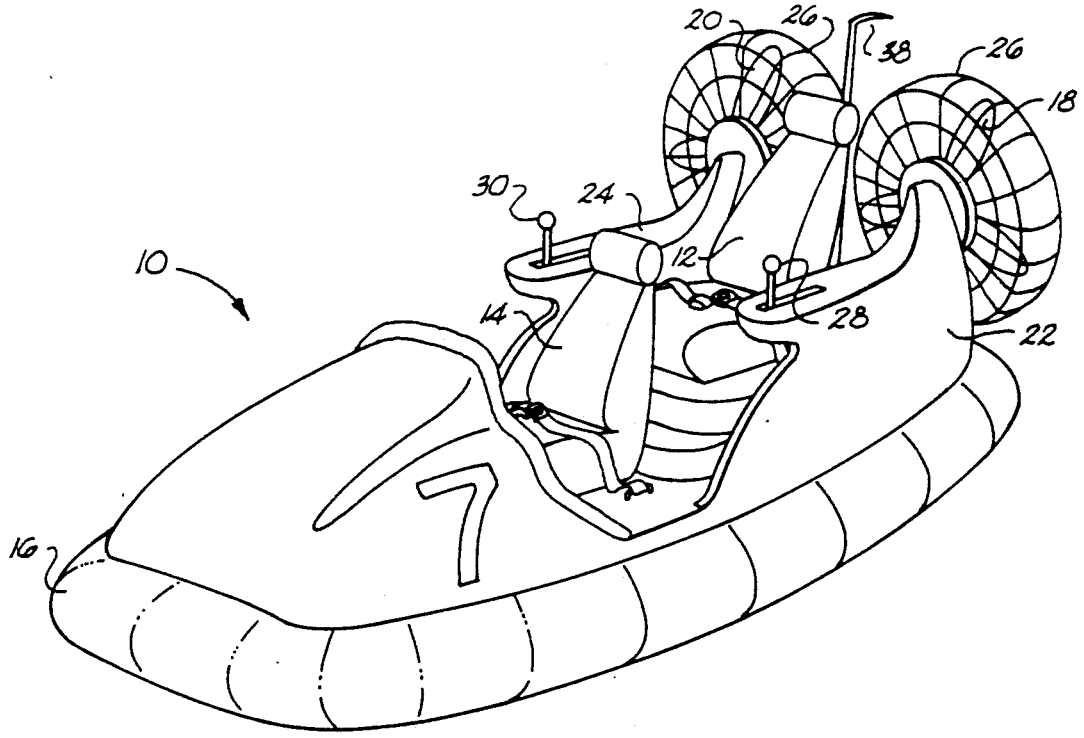
FIG. 1 is an isometric view of a vehicle body or car arranged in accordance with the present invention.

As shown in FIG. 1, the present invention is incorporated in an amusement vehicle body or car, generally indicated by the reference numeral 10 containing a rear, upper passenger seat 12 and a forward passenger seat 14 positioned slightly below the seat 12.

Preferably, the form of the car 10 is oblong and is provided with a vehicle bumper surrounding the same. Propulsion is imparted to the car by means of two large propellers 18, 20 mounted for rotation upon axles securely mounted for rotation upon suitable upwardly projecting vehicle frames 22, 24, respectively. Suitable wire guards 26 surround the propellers to protect passengers and nearby persons from injury caused by the propeller rotation.

As will be described below, the rotational speed of the propellers and their direction of rotation for effecting different motions to the car 10 are under control by suitable control devices 28, 30 available for use by the passenger in the rear upper seat 12.

Figure 2:
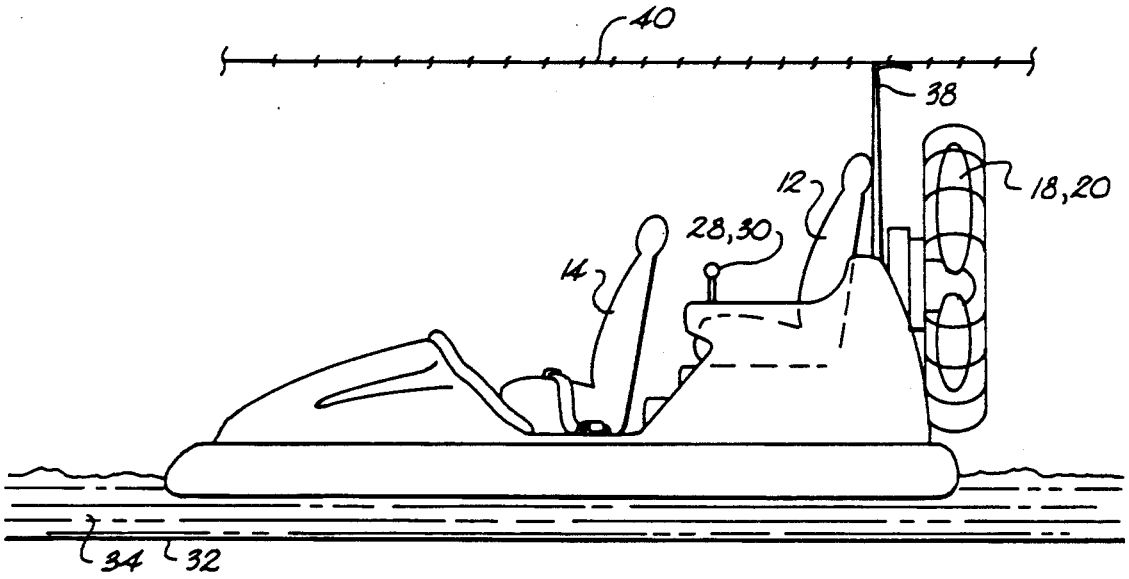
FIG. 2 is an elevational view of the vehicle car shown in relation to the riding platform on which water is placed for the flotation of the cars.

The preferred form of support and movement for the car 10 is illustrated in FIG. 2 wherein the car is shown upon a riding platform 32 upon which water 34 is placed for the floating of the car thereon. In this embodiment, the car 10 is floating on the water 34 which may have a depth of between 4 and 6 inches. The propellers 18, 20 are driven by individual electrical motors or a single motor to be described hereinafter, which receives its electrical energy from an electrical pick-up device 36 secured to the car 10 and in contact with the platform 32. In this arrangement, the platform 32 is made from metallic material adapted to conduct electrical energy to the car 10 by means of the pick-up device 36. As an alternative, the water 34 may contain an electrolyte dissolved therein for providing the electrical connection to the platform 32 thereby eliminating the need for the pick-up device 36. Still another alternative would be the use of a wand 38 slidably engaged with an overhead oriented electrical wire mesh 38 for receiving energy for the electrical motor(s).

Figure 3:
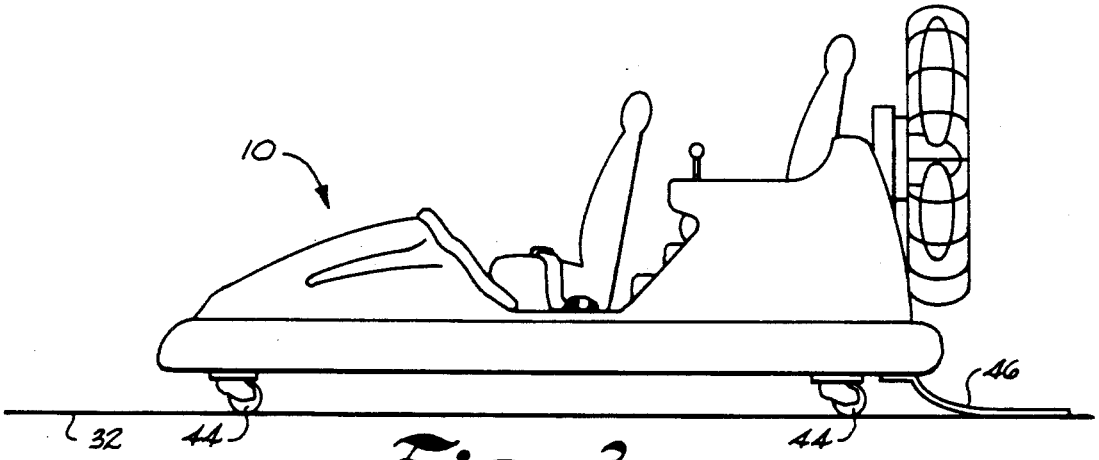
FIG. 3 is an elevational view of the car showing the same being supported on a riding platform by a plurality of swivelable caster wheels.

In the embodiment of FIG. 3, the car 10 is shown with a plurality of swivelable caster wheels 44 which support the car upon the platform 32 for random movement thereon. An electrical pick-up device 46 may be connected between the lower section of the car 10 and the riding platform 34 for conducting electrical energy to the drive motor(s) for the car.

Figure 4:
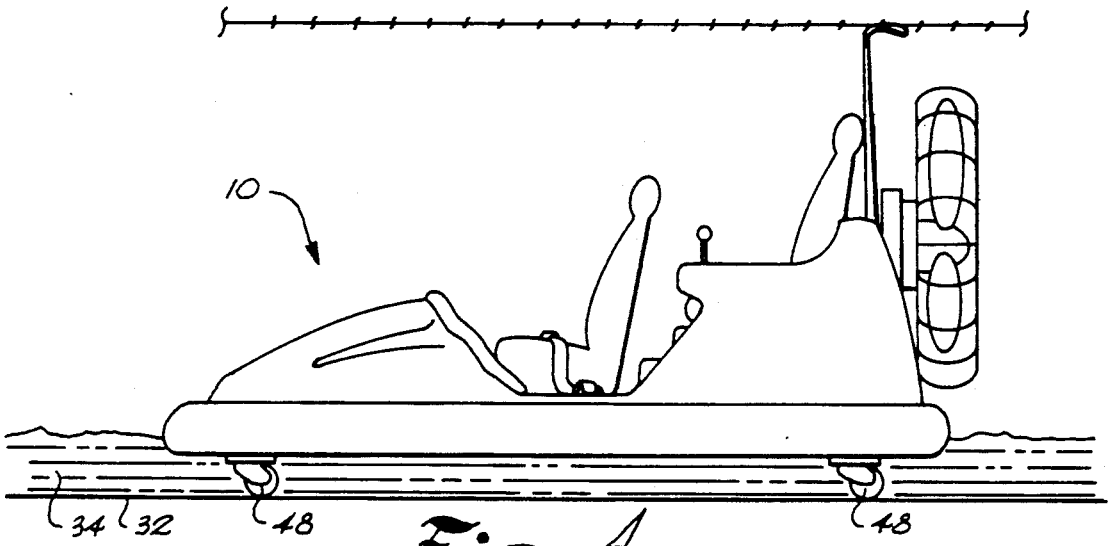
FIG. 4 is an elevational view of the car showing the same floating on water and utilizing caster wheels.

Another embodiment of the present invention is illustrated in FIG. 4 as combining the principles of support and car movement shown in FIGS. 2 and 3. In this embodiment, a plurality of caster wheels 48 support the vehicle 10 upon the platform 34 and water 34 is also provided in order to give the passengers the illusion of riding on water. In both of the embodiments of FIGS. 2 and 4, the water 34 will serve as a speed retarding means so that the vehicle 10 cannot run away or be propelled too fast for proper control and safety. The bumper guard 16 is made large enough and of a material which provides sufficient retardation of car speed in the presence of the water 34 for the illustrated arrangements.

Figure 5:
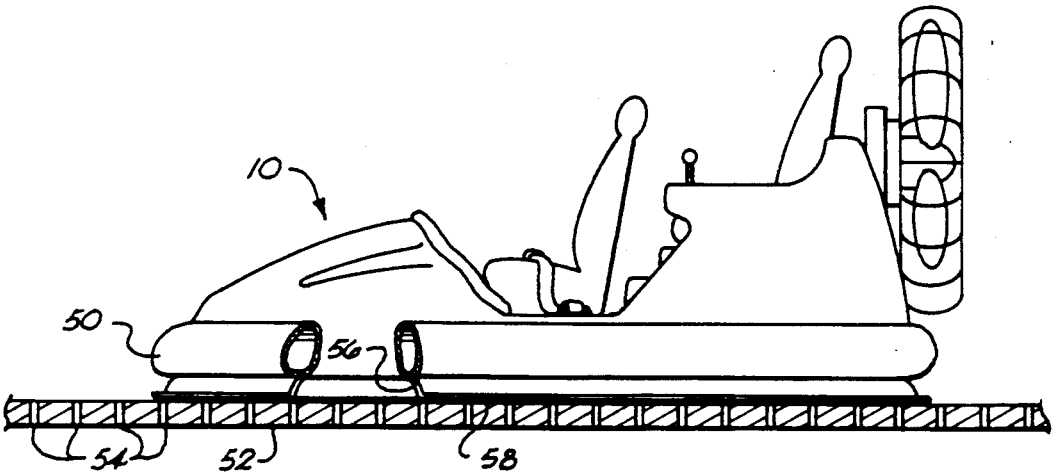
FIG. 5 is an elevational view of the car arranged for movement upon a riding platform utilizing air flotation principles.

The embodiment of FIG. 5 employs air flotation principles which serve to support the vehicle 10 for movement along the riding platform.

The car, preferably made of fiberglass, includes a bumper guard formed as an inflated urethane coated nylon tube 50, surrounding and held in an annular groove formed around the car. The tube 50 is held slightly above the surface of riding platform 52, which is formed with holes 54 for use in the air flotation. The car also includes an inverted saucer-shaped base 56 which cooperates with the riding platform 52 to effect air flotation of the car. The base 56, also made of fiberglass, has an outer rim 58 coated with a thick layer (not shown) of an ultra-high molecular weight material to minimize wear of the rim and also provide some lubrication for the sliding movement of the car. The holes 54 may be connected to a suitable source of air pressure capable of supporting the car above the surface of the riding platform and permit random movement of the car during propulsion thereof.

Figure 6:
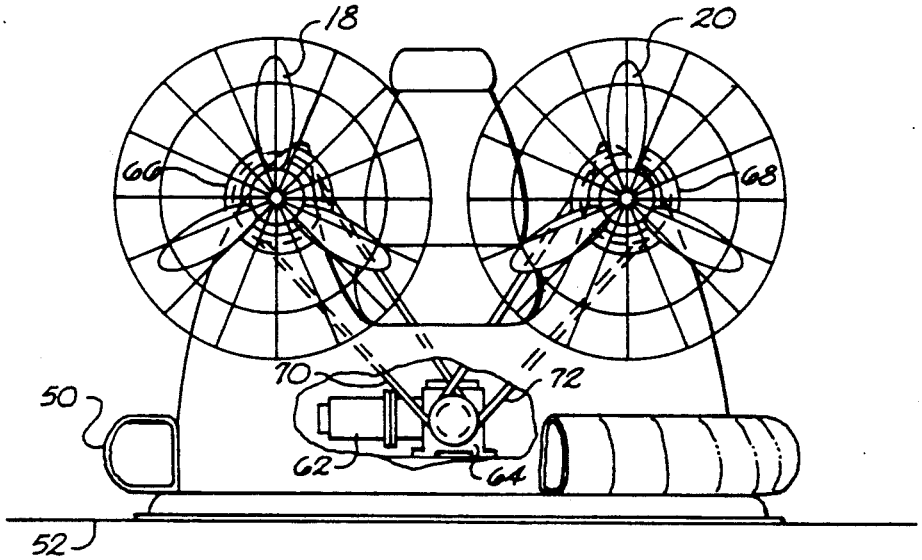
FIG. 6 is a rear view of the car and a schematic view of a drive mechanism and control therefor for the propellers.

The drive system for the car 10 is illustrated in FIG. 6 as including an electrical motor 62 arranged with its shaft operatively engaged with a drive means 64. The drive means 64 is operatively connected to pulleys 66, 68 secured to the axles for the propellers 18, 20 respectively, by means of drive chains or belts 70, 72.

The drive means 64 is arranged to impart rotation to the propellers 18, 20 separately, and in either direction of rotation. Under control by the passenger control devices 28, 30, which are operatively connected to the drive means 64, the speed of each of the propellers, in either direction of rotation, may be regulated, thereby providing the passenger with a variety of interesting and amusing options of car movements. The devices 28, 30 are preferably of the lever throttle type whereby forward movement of the same effects rotation of a propeller to propel a car forward, and to a speed indicative of the extent of the forward movement, center position of the throttle disengages the propeller to terminate propelling movement, and backward movement effects rotation to propel the car in reverse and to a speed indicative to the extent of the throttle movement.

As previously stated, many amusing and thrilling options are available to the passenger in a car which is non-guided in its movement and otherwise is free for random-direction motion. For example, with both devices 28, 30 fully forward, the car will move forward at its highest available speed. The reverse is true if the devices are placed in the full backward positions. However, in the event one of the devices is moved forward and the other in reverse, the car will turn and the radius of turning may vary anywhere from a gradual, gentle turn to a spinning turn, depending upon the extent to which the throttle devices are manipulated. Gentle turning and spinning and variation thereof may be made in either direction and may be combined to effect S-turns.

While the foregoing description of a car drive system is in the form of a single electrical motor, it will be understood that two electrical motors may be utilized, one for each of the propellers, and that a single drive means may be combined with each individual motor and propeller. With this arrangement, both control devices 28, 30 will be operatively connected to both drive means so that all of the control options and operations available with the single motor, as described above, will also be available for a two-motor drive system.

Figure 7:
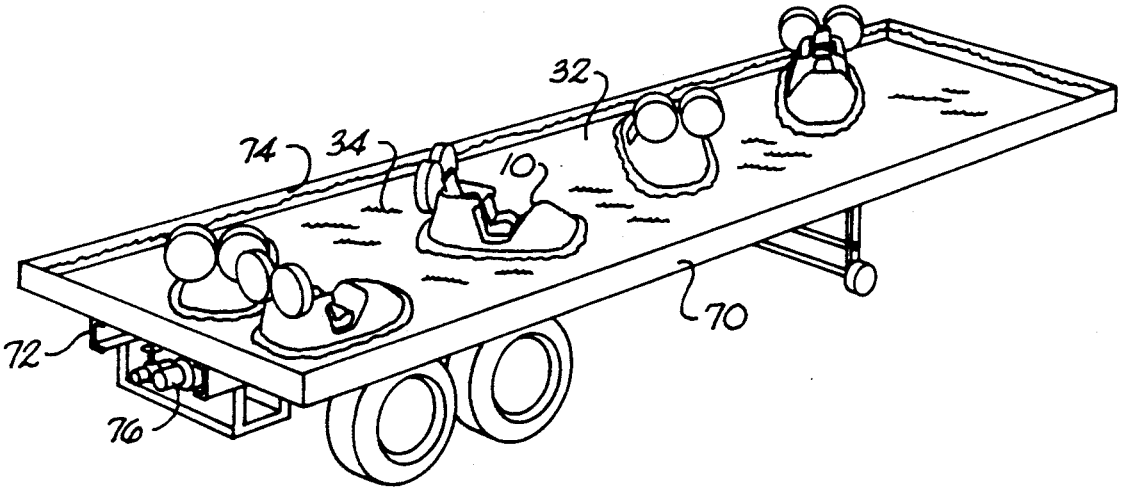
FIG. 7 is an isometric view of a trailer bed upon which the present invention is adapted to be utilized for amusement operation.

From the foregoing, it will be appreciated that an amusement ride has been devised which will provide the effect and illusion of a swamp airboat, and which is arranged with the capability of an infinite variety of options in the direction of car movement, speed and maneuverability. It will also be appreciated that the composition of the riding structure, when compared to the extent of the pleasure which is available, is very simple, cost effective, and may be incorporated with mobile riding platforms such as a semi-trailer truck, as shown in FIG. 7, capable of moving the ride structure and its attended components from place to place. With respect to the riding activities of one or more cars 10 upon a trailer vehicle with the bed thereof serving as the riding platform 32, the frame 72 for the trailer may be devised as a water reservoir 74 with the water 34 being dumped into the reservoir at the end of a ride during unloading and loading passengers, and is pumped by means of a pump 76 from the reservoir and onto the platform just prior to the next riding event.

Those of ordinary skill in the art will also understand and appreciate that the foregoing specification references to the accompanying figures is intended merely as a description of a specific preferred embodiment and other embodiments, and is not intended as limiting the spirit and scope of the present invention, which is set forth in the appended claims.

What is claimed is:

1. An amusement apparatus of the air propelled, swamp boat type comprising:

a mobile trailer having a trailer bed arranged as an amusement riding platform, an amusement car arranged for supporting and transporting one or more passengers, said car including means for supporting the same upon said riding platform and permitting said car to move randomly thereacross when a propulsion force is applied thereto, means for providing a propulsion force to said car, said propulsion means having at least one propeller arranged at one end of said car, said riding platform having water thereon and said car supporting means being adapted to float thereon during movement thereof, control means arranged on said vehicle body for use by a passenger therein and connected to said propulsion means for selectively controlling the forward and reverse motion thereof, said trailer including a water reservoir for containing the water when the amusement apparatus is inoperative.

2. An amusement apparatus of the air propelled, swamp boat type comprising:

a vehicle body arranged for supporting and transporting one or more passengers, said vehicle body including means for supporting the same upon a riding platform and permitting said body to move randomly thereacross when a propulsion force is applied thereto, said riding platform being formed with a plurality of openings and said vehicle body supporting means includes means for cooperating with said platform for the air flotation movement of said vehicle body.

means for providing a propulsion force to said vehicle body, said propulsion means having a pair of propellers arranged at one end of said body and motor means operatively connected thereto, drive means associated with said motor means and adapted for imparting forward and reverse motion individually to each of said propellers, and control means arranged on said vehicle body for use by a passenger therein and connected to said drive means for selectively controlling the forward and reverse motion of each of said propellers, and thereby imparting the forward, reverse and turning propulsion force to said vehicle body.

3. An amusement apparatus of the air propelled, swamp boat type comprising:

a mobile trailer having a trailer bed arranged as an amusement riding platform, an amusement car arranged for supporting and transporting one or more passengers, said car including means for supporting the same upon said riding platform and permitting said car to move randomly thereacross when a propulsion force is applied thereto, said mobile trailer being adapted to transport said amusement apparatus from site to site on said trailer bed and operated at a site using the trailer bed as a riding platform, means for providing a propulsion force to said car, said propulsion means having at least two propellers arranged at one end of said car, said means for supporting said amusement car including caster wheel for supporting said car on said trailer bed for permitting random motion around said platform, control means arranged on said vehicle body for use by a passenger therein and connected to said propulsion means for selectively controlling the forward and reverse motion thereof for driving said car on said trailer bed.

4. The amusement apparatus as set forth in claim 3 further comprising a layer of water carried upon said trailer bed.

* * * * *